United States Patent [19]

Ohtaki et al.

[11] Patent Number: 4,730,589

[45] Date of Patent: Mar. 15, 1988

[54] AUTOMATIC CHOKE SYSTEM FOR AN AUTOMOTIVE ENGINE

[75] Inventors: Kiyoshi Ohtaki, Fuchu; Kazuo Hara, Musashino, both of Japan

[73] Assignee: Fuji Jukogyo Kabushiki Kaisha, Tokyo, Japan

[21] Appl. No.: 787,398

[22] Filed: Oct. 15, 1985

[30] Foreign Application Priority Data

Oct. 22, 1984 [JP] Japan ..... 59-222630

[51] Int. Cl.[4] ..... F02M 1/12

[52] U.S. Cl. ..... 123/438; 123/179 G; 261/39.6

[58] Field of Search ..... 123/179 A, 179 B, 179 G, 123/180 T, 438; 261/39 E

[56] References Cited

U.S. PATENT DOCUMENTS 3,768,453 10/1973 Hurst ..... 123/179 G 3,818,881 6/1974 Hosho et al. ..... 261/39 E 4,344,898 8/1982 Takada et al. ..... 261/39 E 4,463,723 8/1984 Tansuwan ..... 123/179 G 4,562,819 1/1986 Kobayashi et al. ..... 123/179 G

*Primary Examiner*—Andrew M. Dolinar

*Attorney, Agent, or Firm*—Martin A. Farber

[57] ABSTRACT

An automatic choke system has a thermostatic spring connected to a choke valve, and a heater for heating the thermostatic spring so as to open the choke valve. A control circuit is provided for controlling the current passing through the heater. At starting of an engine, when cooling water temperature is lower than a predetermined temperature the control circuit operates to decrease the current so as to slowly open the choke valve. When the cooling water temperature is higher than a predetermined temperature, a rated current is supplied to the heater so as to quickly open the choke valve.

5 Claims, 4 Drawing Figures

AUTOMATIC CHOKE SYSTEM FOR AN AUTOMOTIVE ENGINE

BACKGROUND OF THE INVENTION

The present invention relates to an automatic choke system of an internal combustion engine for an motor vehicle wherein a choke valve is automatically opened by current supplied to a heater, and more particularly to a system wherein the opening degree of the choke valve is controlled at cold engine operation.

The automatic choke system in general comprises a thermostatic spring, a heater made of electric heating material such a nichrome, a positive temperature coefficient (PTC) element, and ceramics, for heating the thermostatic spring. With regulations on emission control in recent years, the choke valve is set taking emission control into consideration. In order to meet a requirement of emission control, the valve is designed to open early so as to prevent extreme enrichment of the air-fuel mixture for the engine.

The choke valve is controlled to close at all times except at coolant temperatures higher than a predetermined temperature (for example, 80° C.). Accordingly it is desirable that the system have characteristics of controlling the choke valve at low coolant temperature, for example about 0° C., as well as at normal temperature (about 25° C.). However, the air-fuel ratio is liable to be increased to supply a lean mixture at lower temperatures, since the automatic choke system is constructed to open the choke valve early. As a result, driveability of the vehicle decreases at cold engine operation.

SUMMARY OF THE INVENTION

The object of the present invention is to provide an automatic choke system wherein a choke valve is properly opened at low temperature as well as at normal temperature so as to improve driveability.

The other objects and features of this invention will become understood from the following description with reference to the accompanying drawings.

BRIEF DESCRIPTION OF THE DRAWINGS

FIGS. *2a* and *2b* constitute a flowchart explaining the operation of the present invention.

DETAILED DESCRIPTION OF THE PREFERRED EMBODIMENT

Figure 1:
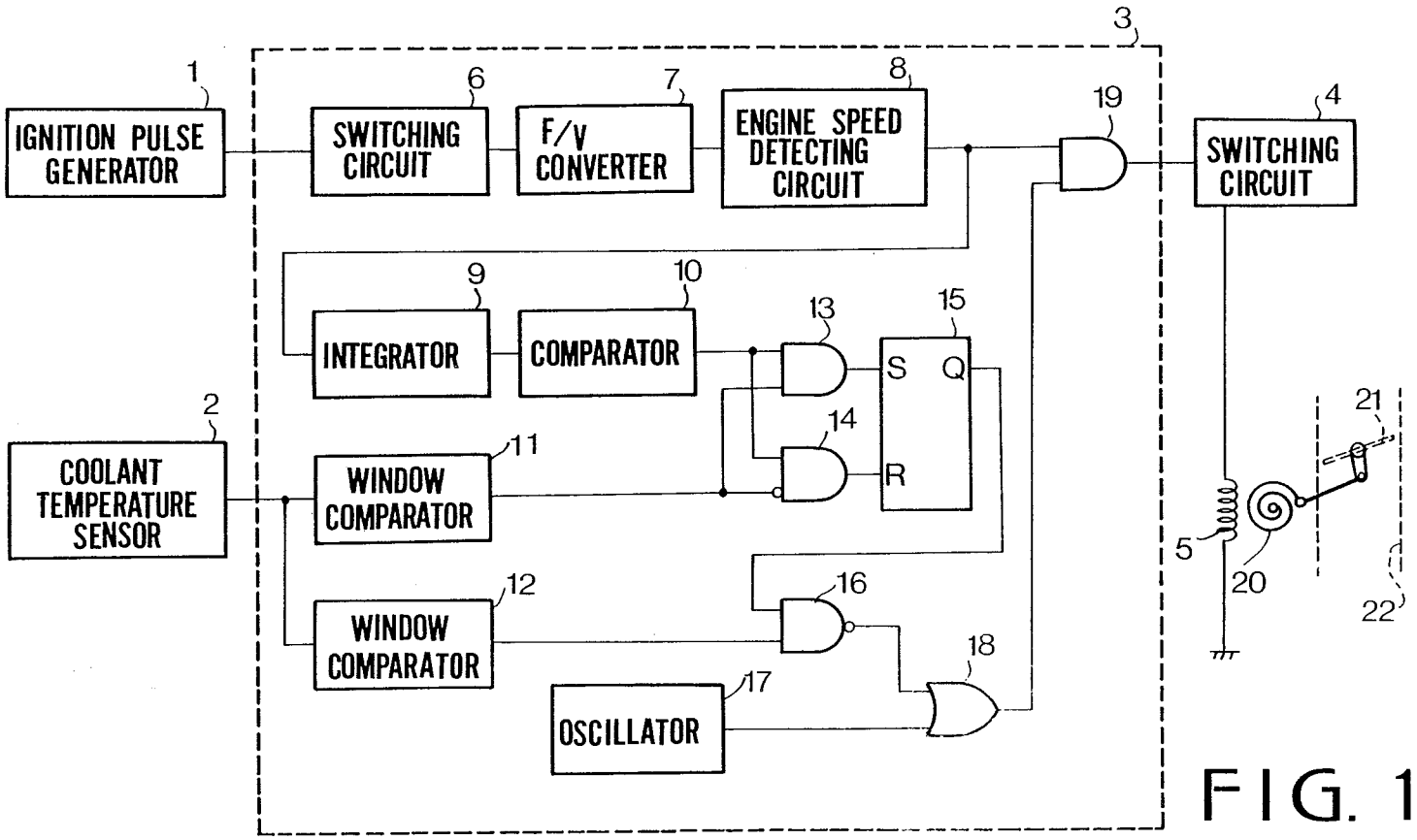
FIG. 1 is a schematic block diagram showing a circuit of the system according to the present invention.

Referring to FIG. 1, the system of the present invention is provided with an ignition pulse generator 1 and a coolant temperature sensor 2, outputs thereof being applied to a control unit 3. The output of the control unit 3 is connected to a choke heater 5 through a switching circuit 4 so as to supply a current to the heater (coil) 5. The heater 5 is adapted to heat a thermostatic spring 20 connected to a choke valve 21 provided in an intake passage 22 of an engine of a vehicle.

In the control unit 3, the output of the ignition pulse generator 1 is converted into square wave pulses by a wave-form shaping circuit 6. The pulses are applied to an engine speed detecting circuit 8 through a F/V converter 7 which converts the frequency of the square wave pulses into voltage. The engine speed detecting circuit 8 is adapted to produce a high level output when the engine speed after the starting exceeds a predetermined value, for example 400 rpm. The output of the engine speed detecting circuit 8 is applied to an integrator 9 and the high level output is charged therein at a certain time constant. The output of the integrator 9 is applied to a comparator 10 which produces a high level output when the charged voltage is below a reference voltage.

The output of the coolant temperature sensor 2 is connected to a window comparator 11 which produces a high level output when the input signal of which is in a predetermined range, for example, between −10° C. and 10° C. The output of the coolant temperature sensor 2 is also connected to a window comparator 12 which produces a high level output when the input signal is between 40° C. and 70° C.

The outputs of the window comparator 11 and comparator 10 are respectively applied to AND gates 13 and 14, the outputs of which are, respectively applied to a set terminal and a reset terminal of a flip-flop 15. The outputs of the flip-flop 15 and the window comparator 12 are applied to a NAND gate 16. The AND gate 14 produces a high level output, when the input from the window comparator 11 is at a low level and the input from the comparator 10 is at a high level.

The system further comprises an oscillator 17 which produces pulses having a duty ratio, for example, of 50%. The output of the oscillator 17, together with the output of the NAND gate 16, is connected to an OR gate 18. The outputs of the engine detecting circuit 8 and the OR gate 18 are connected to the switching circuit 4 through an AND gate 19. When the output of the AND gate 19 is at a high level, the circuit 4 operates to supply a current to the choke heater 5.

The operation of the system of the present invention is explained hereinafter. When the engine speed during starting of the engine is under 400 rpm, the output of the engine speed detecting circuit 8 is at a low level, causing the output of the AND gate 19 to go to a low level. Accordingly, switching circuit 4 operates to cut off the current, so that the thermostatic spring is not heated, thereby closing the choke valve 21.

Figure 3:
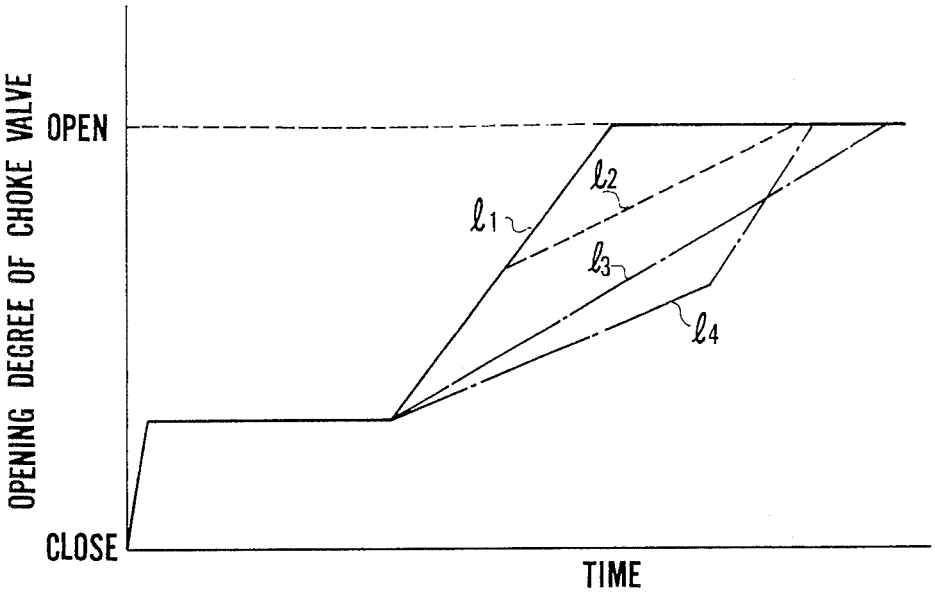
FIG. 3 is a graph showing opening characteristics of a choke valve of the present invention.

When the engine speed exceeds 400 rpm, the output of the engine speed detecting circuit 8 becomes high level, and the high level output is applied to the integrator 9 and the AND gate 19. Until the charged voltage in the integrator 9 reaches the reference voltage of the comparator 10, the output of the comparator 10 is at a high level. On the other hand, when the coolant temperature is higher than the predetermined value of 10° C., the output of the window comparator 11 goes to a low level, so that the output of the AND gate 14 becomes high level, thereby resetting the flip-flop 15 to produce a low level output. Accordingly, the NAND gate 16 produces a high level output regardless of the level of output of the comparator 12. The high level output of the NAND gate 16 is applied to the AND gate 19 through the OR gate 18 to change the output of the AND gate to a high level. Accordingly, the switching circuit 4 is operated to supply a rated current to the choke heater 5 thereby to open the choke valve in accordance with the characteristic shown by the line $l_1$ in FIG. 3.

On the contrary, when the coolant temperature is within the range of −10° C. to 10° C. at the start of the engine, the output of the AND gate 13 is at a high level to set the flip-flop 15, rendering the output thereof high. Since the output of the window comparator 12 is at a low level, the NAND gate 16 produces a high level output. Thus, the choke valve starts to open, as aforementioned, in accordance with the characteristic shown by line $l_1$ in FIG. 3. When a predetermined period (1 sec.) lapses after the start and the charged voltage exceeds the reference voltage, the output of the comparator 10 becomes low. However, the output of the flip-flop 15 remains high level. When the coolant temperature rises to a value in the range of 40° C. to 70° C., the window comparator 12 produces a high level output, causing the output of the NAND gate 16 to go to a low level. Therefore, pulses having the duty ratio of 50% from the oscillator 17 are applied to the switching circuit 4 through the OR gate 18 and AND gate 19 to control the current supplied to the heater 5. Accordingly, the current is cut by half when the coolant temperature is between 40° C. and 70° C. so that the choke valve is gradually opened in accordance with the characteristic shown by line $l_2$ in FIG. 3.

Therefore, at low temperature, the opening speed of the choke valve is retarded compared with the speed at the normal temperature, thereby to lengthen the effective period of the choke valve and the air-fuel mixture is kept rich for a longer period. Consequently, the warming up of the engine is enhanced and fuel shortage during driving can be avoided.

In another embodiment of the present invention, a timer is employed so as to determine the period for the control of the duty ratio of the current supplied to the choke heater. The control by the pulses may be used in the entire period of current supply as shown by line $l_3$ in FIG. 3, or only in a starting period of the opening of the choke valve as shown by line $l_4$.

Figure 2A:
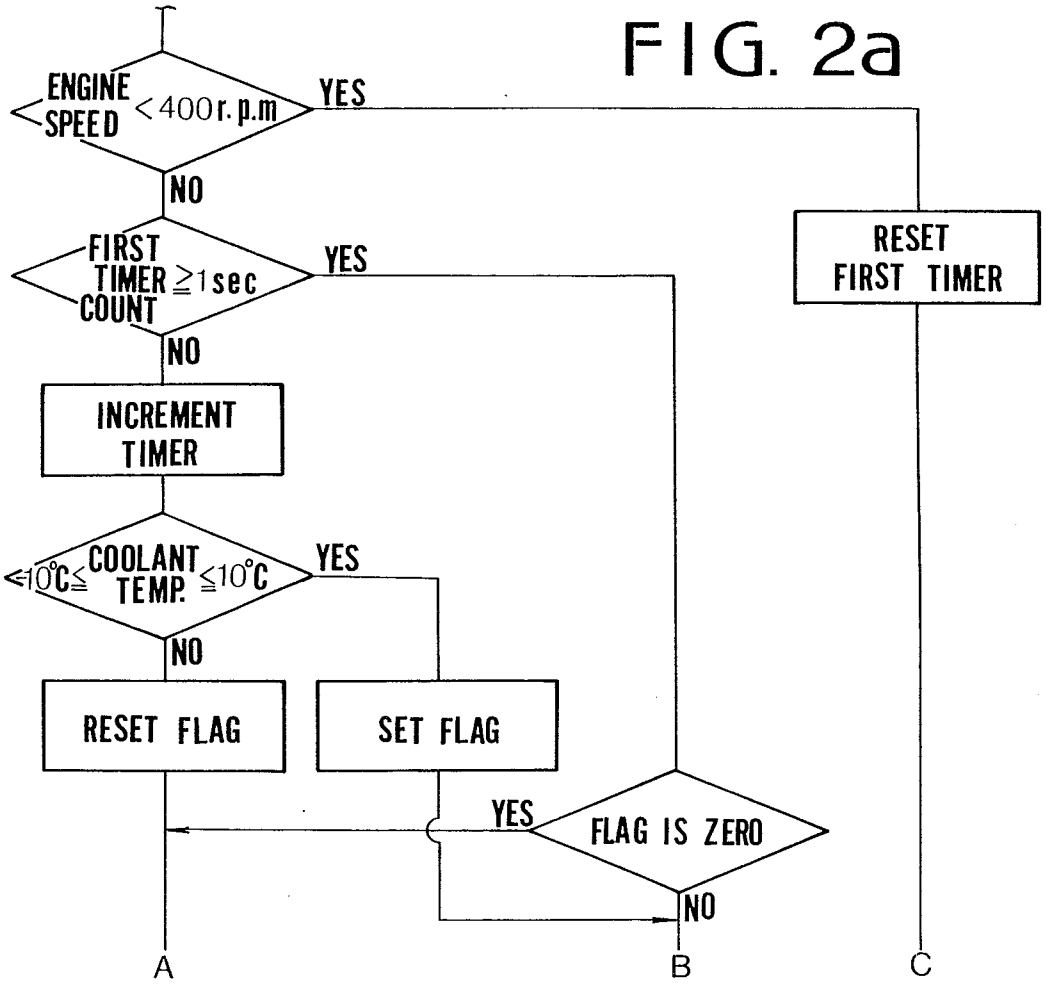
Figure 2B:
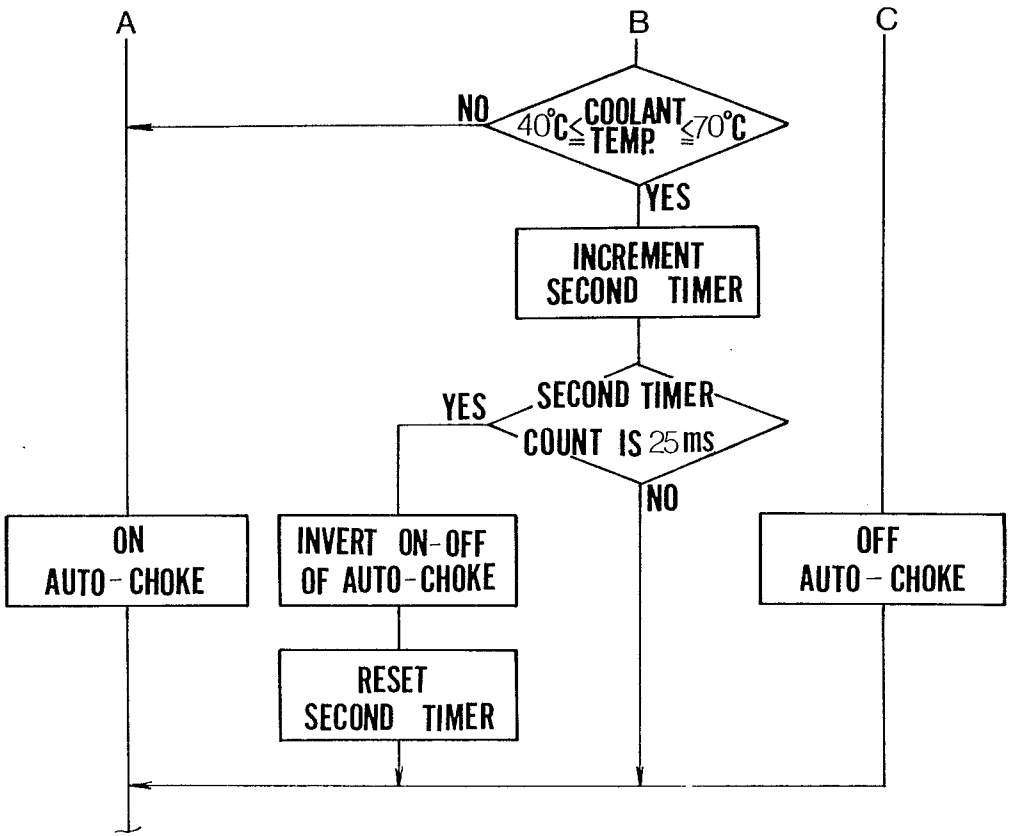

Additionally, the present invention may be applied to a PTC heater. A microcomputer system can be also used in the system of the present invention. FIG. 2 shows the operation of the microcomputer system.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. In an automatic choke system for an automotive engine having a choke valve, a thermostatic spring operatively connected to the choke valve, a heater operated by current for heating the thermostatic spring so as to open the choke valve, and a circuit for controlling the current passing through the heater, the improvement comprising:

first means for detecting cooling water temperature lower than a predetermined temperature and for producing a low temperature signal;

second means for detecting cooling water temperature higher than a predetermined temperature and for producing a high temperature signal;

third means responsive to the high temperature signal for supplying the current to the heater; and fourth means responsive to the low temperature signal for decreasing the current so as to retard the opening speed of the choke valve, said fourth means decreases said current responsive to the high temperature signal at starting of the engine.

2. In an automatic choke system for an automotive engine having a choke valve, a thermostatic spring operatively connected to the choke valve, a heater operated by current for heating the thermostatic spring so as to open the choke valve, and a circuit for controlling current passing through the heater, the improvement comprising:

first means for detecting cooling water temperature and for producing a first temperature signal when the temperature is lower than a predetermined first temperature and producing a second temperature signal when the temperature is higher than the first temperature;

second means for detecting cooling water temperature and for producing a third temperature signal when the temperature is higher than a predetermined second temperature which is higher than the first temperature;

third means for producing an engine speed signal when speed of the engine reaches a predetermined speed at starting of the engine;

fourth means responsive to the engine speed signal and to the first temperature signal for producing a first signal and responsive to the engine speed signal and to the second temperature signal for producing a second signal;

fifth means responsive to the first signal for supplying the current to the heater and respectively responsive to the third temperature signal for reducing the current supplied to the heater so as to retard speed of opening of the choke valve after a period after the starting of the engine; and said fifth means being further respectively responsive to the second signal for supplying the current regardless of the third temperature signal.

3. The automatic choke system according to claim 2, wherein the fifth means comprises pulse generating means for generating pulses, and means responsive to the third temperature signal and another signal for outputting the pulses, and switching means responsive to the pulses to reduce the current.

4. The automatic choke system according to claim 2, wherein said heater is a PTC heater.

5. The automatic choke system according to claim 2, further comprising timing means for signaling said period after the starting of the engine to said second gate means.

* * * * *